US005609346A

United States Patent [19]

Bellehumeur

[11] Patent Number: 5,609,346

[45] Date of Patent: Mar. 11, 1997

[54] TOE ACTIVATED BRAKING SYSTEM FOR INLINE ROLLER SKATES

[76] Inventor: Alex R. Bellehumeur, 6242 Napoli Ct., Long Beach, Calif. 90803

[21] Appl. No.: 401,798

[22] Filed: Mar. 10, 1995

[51] Int. Cl.[6] ..... A63C 17/14

[52] U.S. Cl. ..... 280/11.2; 188/4 R; 188/29; 280/11.22

[58] Field of Search ..... 280/11.2, 11.22, 280/11.23, 11.19; 188/4 R, 29

[56] References Cited

U.S. PATENT DOCUMENTS

| | | | |
|---|---|---|---|
| 1,517,352 | 12/1924 | Foote | 280/11.2 |
| 4,027,890 | 6/1977 | Volkmann | 280/11.2 |
| 5,143,387 | 9/1992 | Colla | 280/11.22 X |
| 5,340,131 | 8/1994 | Smathers et al. | 280/11.2 |
| 5,403,021 | 4/1995 | Shifrin | 280/11.2 |

*Primary Examiner*—Brian L. Johnson
*Assistant Examiner*—Michael Mar
*Attorney, Agent, or Firm*—Edgar W. Averill, Jr.

[57] ABSTRACT

A toe activated braking system for inline roller skates. A slidable plate is positioned under the wearer's toes. When the wearer bends his toes downwardly and rearwardly the plate moves rearwardly and moves an arm which is linked to a brake pad. As the toes are bent downwardly the brake pad is moved into contact with one or more of the inline rollers.

2 Claims, 3 Drawing Sheets

TOE ACTIVATED BRAKING SYSTEM FOR INLINE ROLLER SKATES

BACKGROUND OF THE INVENTION

The field of the invention is sporting goods and the invention relates more particularly to inline roller skates. Whereas ice skates may be readily stopped by moving the blades laterally across the ice surface, this does not work for inline roller skates. As a result, other braking systems have been devised to assist the skater to slow down and stop. One such brake is shown in U.S. Pat. No. 5,253,883 where a brake pad is pressed against the skating surface. Other constructions for such brakes are shown in U.S. Pat. Nos. 5,067,736; 5,052,701; and 5,028,058. There are several deficiencies with this sort of design. Most importantly, the brake typically can only be placed on one of the two skates, or at least only one of the two skates can be used for braking at any one time. Typically, the skate with the brake pad on the back is placed in front of the other skate and tilted rearwardly so that the brake pad rubs against the skating surface. This is often not practical if one is, for instance, going down an incline and merely wants to slow down slightly. Furthermore, because the braking is done only on one skate, it tends to turn the skater and generally limit his control. The brake pad cannot effect a quick stop without loss of control, except for a very good skater. With few exceptions, such a device is very dangerous to a skater.

SUMMARY OF THE INVENTION

It is an object of the present invention to provide a braking system for inline roller skates which may be operated by the wearer by simply bending his or her toes downwardly and rearwardly.

It is another object of the present invention to provide a braking system for inline roller skates which may be used on both skates while braking.

The present invention is for a toe activated braking system for inline roller skates. The roller skates have a sole which supports a frame which in turn supports typically four inline rollers. The system has a brake pad which is supported adjacent one or more of the inline rollers. The brake pad is moveable from a free position where it does not contact one of the rollers to a braking position where it does contact one or more of the rollers. Linkage means are provided for connecting the rearward bending of a user's toes to the brake pad whereby the bending of a wearer's toes will move the brake pad into contact with one or more of the rollers to slow the movement of the inline roller skates. This is done without any need to tilt the skate or any other movement by the skater to cause braking to take place. The linkage means may be either hydraulic or mechanical. The braking system may be activated by the movement of a link or by the compression of a bladder to force a hydraulic medium into a piston or other device to activate the brake.

DESCRIPTION OF THE PREFERRED EMBODIMENTS

Figure 1:
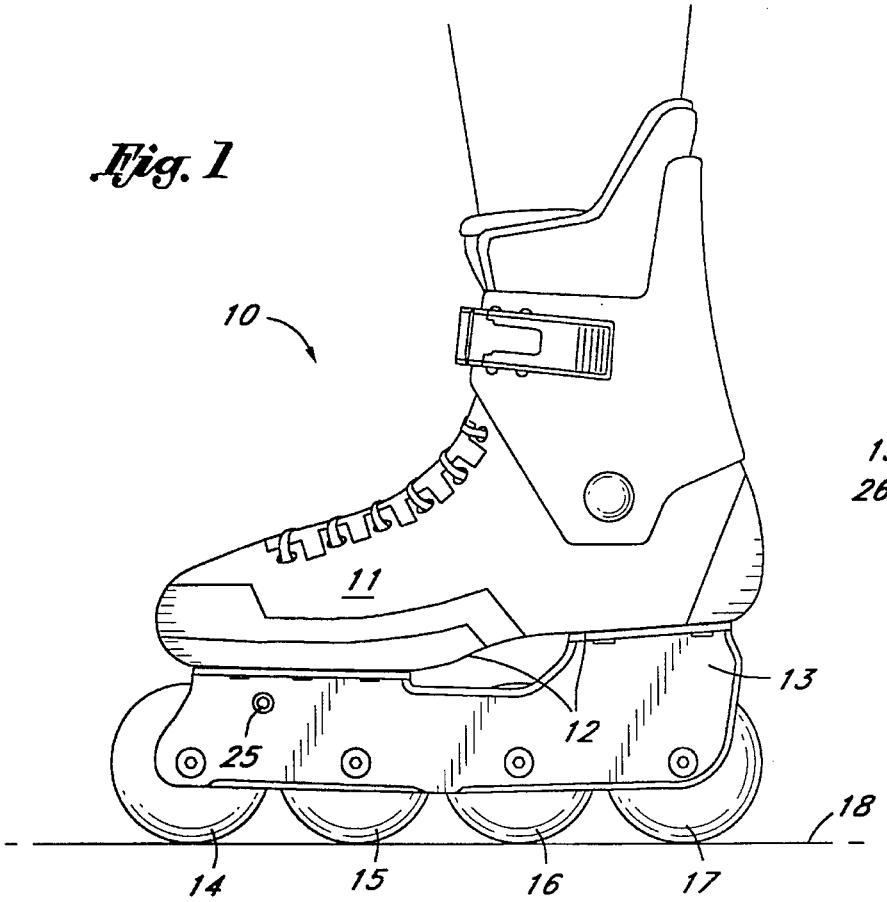
FIG. 1 is a side view of an inline roller skate including the braking system of the present invention.

An inline roller skate is shown in side view in FIG. 1 and indicated generally by reference character 10. Skate 10 has a shoe portion 11 with a sole 12. A frame 13 is held to the sole 12 in a conventional manner and supports four inline rollers 14, 15, 16 and 17. The rollers are supported by a skating surface 18 such as a sidewalk or road.

Figure 2:
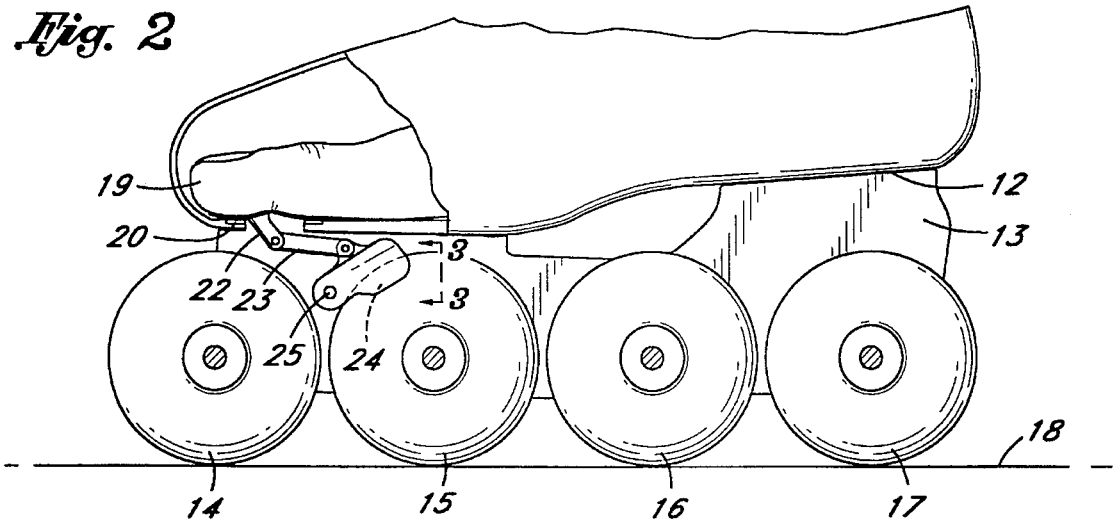
FIG. 2 is a side view partly broken away of the inline roller skate of FIG. 1.
Figure 5:
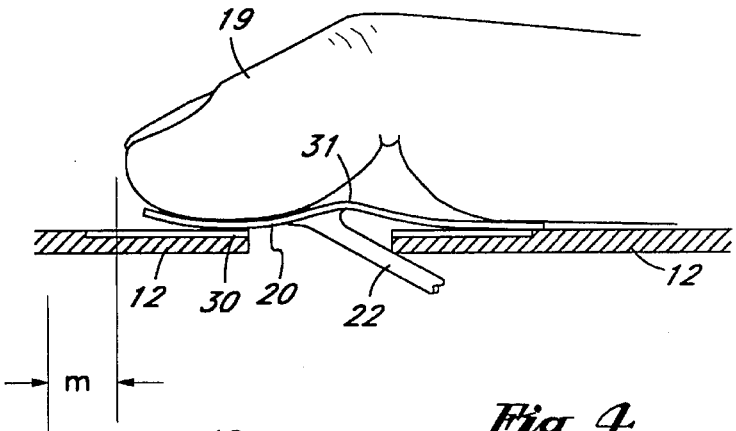
FIG. 5 is a view analogous to FIG. 4, except that the toe is bent downwardly and rearwardly to activate the braking system.
Figure 4:
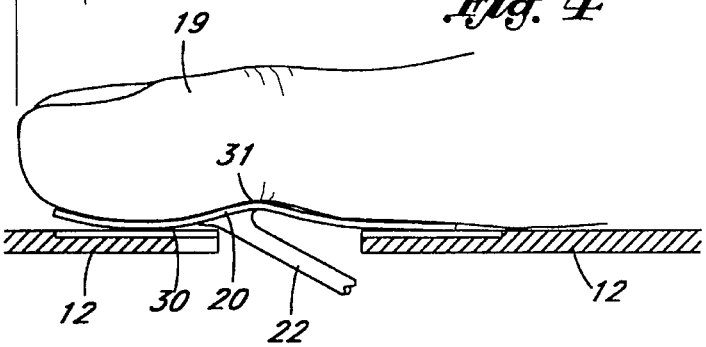
FIG. 4 is a cross-sectional side view of the front portion of the inline roller skate of FIG. 1 with the toe in a normal or skating position.
Figure 7:
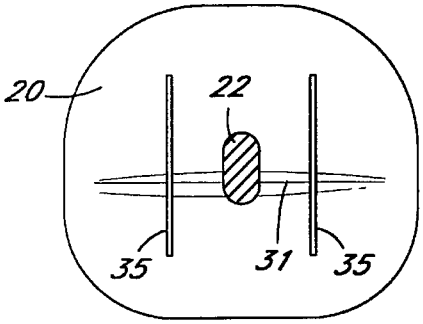
FIG. 7 is a bottom view of the toe plate used in the braking system of the present invention.
Figure 8:
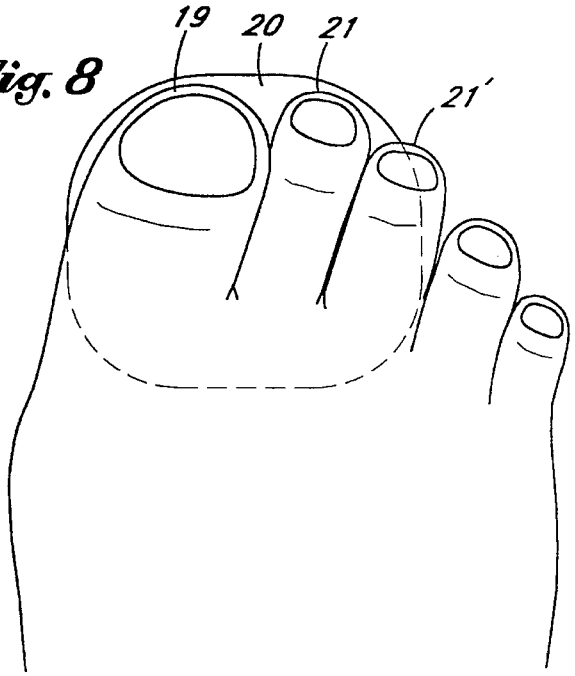
FIG. 8 is a top view of the wearer's toes within the skate of FIG. 1 and showing the toe plate of FIG. 6 therein.
Figure 6:
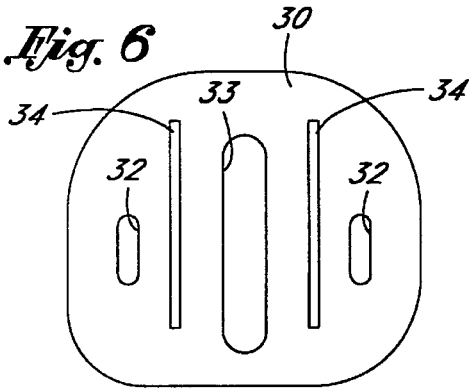
FIG. 6 is a top view of a toe plate support member used in the braking system of the present invention.

Skate 10 is shown in FIG. 2 partially cut away to show the user's big toe 19 which is supported on a shaped toe plate 20 shown in FIG. 7. The plate 20 has a shaped ridge 31 (shown from below in FIG. 7) which is shown in cross-sectional view in FIGS. 4 and 5. This ridge assists in helping the user to control the longitudinal position of toe plate 20 by the users toes 19 and 21. A toe plate support member 30 is affixed to the upper surface of sole 12. Its longitudinal position may be adjusted by the provision adjusting screws (not shown) in slots 32. These screws are used to tighten toe plate support member against the top of sole 12. A central opening 33 permits shaft 22 to pass through support member 30. A pair of grooves 34 slidingly supporting a pair of rails 35 in the bottom of toe plate 20. These grooves and rails should be provided with friction reducing means such as ball bearings. As shown in FIG. 8, toe plate 20 is positioned not only under big toe 19 but also under toes 21 and 21'. It can be seen by comparing FIGS. 4 and 5 that when these toes are bent downwardly, toe plate 20 will move rearwardly typically about ½" as seen by comparing FIGS. 4 and 5 wherein the rearward movement is indicated by reference character "m". This rearward movement is entirely predictable and can be made with great force and effect.

This rearward movement by the skater's toe generates a great deal of power while not interfering with safety or control by the skater. This power can be regulated at will just as the driver of a car regulates his brake by the amount of pressure applied to the pedal. This stopping action is carried out without any need to tilt the skate or any other movement by the skater to cause braking to take place. Unlike all prior art braking systems, the skater remains perfectly in control of his or her balance. Because the braking action may be placed in both skates, the stopping action need never by unbalanced.

The basic concept of the present invention is to utilize this rearward movement of the skater's toes which is readily brought about by the skater to engage a brake against one or more of the inline rollers. One particular way of doing this is indicated in FIG. 2 where a link 22 is shown affixed to the bottom of toe plate 20. Link 22 is affixed to a second link 23 which in turn is linked to a brake pad support member 24 which pivots around pin 25. Pin 25 is supported by frame 13. As the toes are bent, the toe pad moves rearwardly as do links 22 and 23 forcing the support member 24 downwardly so that brake pad assembly 26 shown in FIG. 3 contacts a portion of the outer surface of inline roller 15. It is, of course, contemplated that such a brake pad support member could be located over 2, 3 or all 4 inline rollers. Preferably brake pad assembly 26 has a pair of brake pads 26' which contact wheel 15 on the sloped sides 15' of wheel 15. This provides an especially effective braking action. Because it does not contact a portion of the wheel which contacts skating surface 18, the brake pads are not fouled by particles picked up by the wheels from surface 18.

The effect is to provide the skater with substantially enhanced braking control. The brake can be equally activated in both skates so that no turning action results. Even with brake only in one skate, the skater can retain complete control during slowing or stopping. This complete control results from the ability of the skater to control the amount of bending of the skater's toes.

While a mechanical linkage is shown in FIG. 2, a hydraulic linkage can, of course, be used. By the term "hydraulic" it is intended to indicate that the brake pads could be moved by the operation of a cylinder which is controlled by some sort of fluid or gel such as water, oil or air, or other hydraulic or pneumatic medium. For instance, link 22 could be connected to the piston of a brake cylinder so that the rearward movement would compress the cylinder forcing a hydraulic fluid into one or more brake assemblies.

Figure 9:
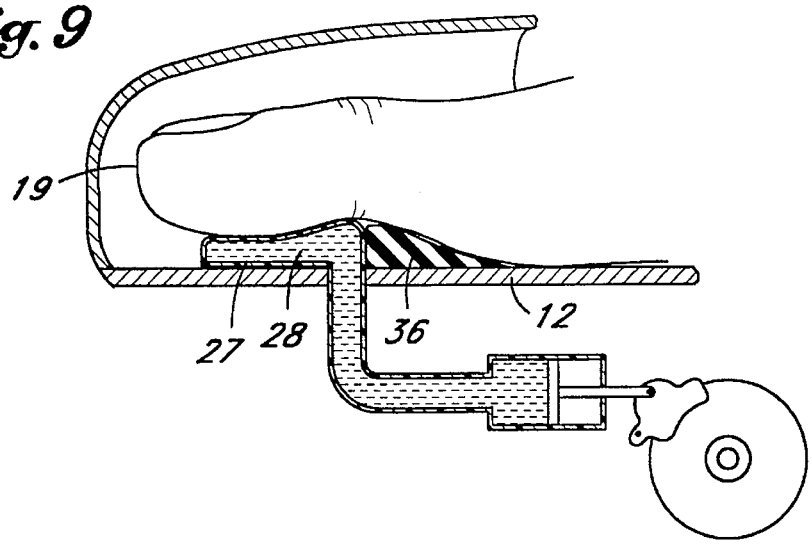
FIG. 9 is a cross-sectional side view of an alternate embodiment of the braking system of the skate of FIG. 1 with the toes in a normal skating position.
Figure 10:
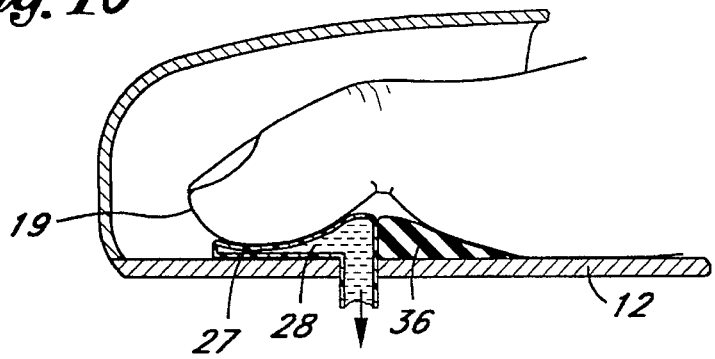
FIG. 10 is a view analogous to FIG. 9 with the toes bent in a downwardly and rearwardly position.
Figure 11:
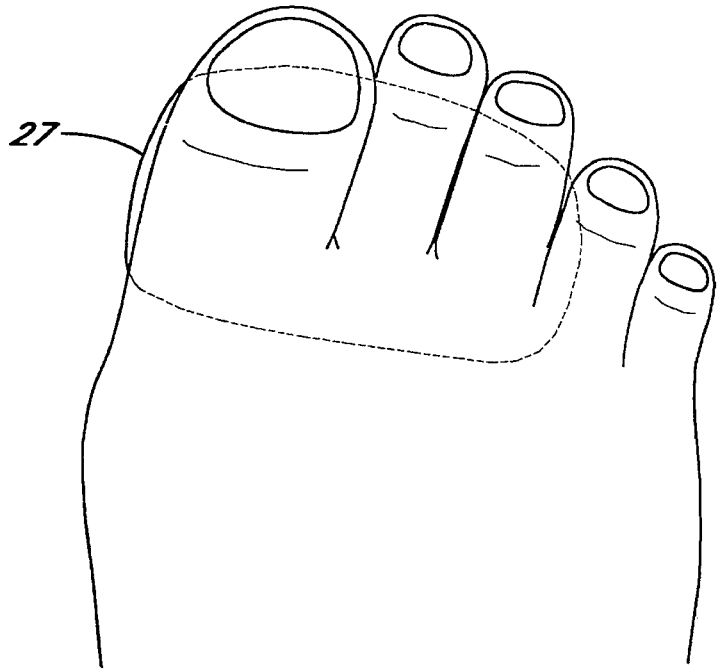
FIG. 11 is a top view of the front of the skate of FIG. 9.

Rather than using the rearward movement of the wearer's toes, it is also possible for the change of position of the wearer's toes to compress a bladder, such as bladder 27 shown in FIG. 9. Bladder 27 is positioned under the wearer's toes as shown in FIG. 11. Bladder 27 may be filled with water, oil, a gel, air or other medium. As the wearer's toes are bent downwardly as shown in FIG. 10, fluid 28 is forced out of bladder 27 through conduit 29 into a hydraulic braking assembly, not shown. Preferably, a shaped soft rubber pad 36 is adhered to the top of sole 12 to help in squeezing fluid 28 out of bladder 27. Since the bladder conforms to the wearer's toes, it is very comfortable. From that point it would be fed to one or more brake cylinders to provide an appropriate amount of braking action.

Figure 3:
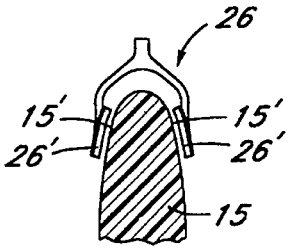
FIG. 3 is a cross-sectional view taken along line 3—3 of FIG. 2.

The braking system of the present invention provides a far more usable braking action than the conventional pad which is dragged behind one of a pair of skates. It is not necessary that the skater move one foot forward and it is also possible for the skater to apply a braking action in either skate or both skates to provide a maximum of control. While the term "brake pad" has been used herein, it is to be understood that this includes any sort of friction member which either contacts the wheel directly as shown in FIG. 3 or contacts a side of the bearing of the wheel or other moveable part of the wheel assembly. Thus, when the phrase "touches an inline roller" is used it is intended to include touching a central wheel portion as well as the flexible polymer portion. The linkage to the braking system may be mechanical, hydraulic or pneumatic.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A toe activated braking system for in-line roller skates which have a sole which supports a frame which, in turn, supports a plurality of in-line rollers, said system comprising:

brake pad means supported adjacent at least one of said in-line rollers, said brake pad means being movable from a free position where it does not contact said at least one of said in-line rollers and a braking position where it touches said at least one of said in-line rollers; and a hydraulically controlled linkage assembly for connecting the rearward bending of a user's toes to said brake pad means, said linkage assembly including a bladder hydraulically connected to a hydraulic piston and linkage means connecting the piston to said brake pad means, whereby the rearward bending of a wearer's toes will compress the bladder thereby moving the brake pad means into contact with said at least one of the rollers to slow the movement of the in-line roller skate and whereby the degree of slowing may be regulated by the degree of pressure applied by a skater's toes.

2. The toe activated braking system of claim 1 wherein said brake pad means comprises a pair of brake pads which may be moved in contact with opposing sides of said at least one of said in line rollers.

* * * * *